US008196259B2

(12) United States Patent
Armstrong et al.

(10) Patent No.: US 8,196,259 B2
(45) Date of Patent: Jun. 12, 2012

(54) DELAYED ACTION DOOR CONSTRAINT WITH REMOTE CLOSING BY AND OF A SECOND DOOR

(75) Inventors: Richard W. Armstrong, Swansboro, NC (US); Daniel Isaak Armstrong, Blacksburg, VA (US)

(73) Assignees: Richard W. Armstrong, Swansboro, NC (US); Daniel Isaak Armstrong, Blacksburg, VA (US)

( * ) Notice: Subject to any disclaimer, the term of this patent is extended or adjusted under 35 U.S.C. 154(b) by 0 days.

(21) Appl. No.: 12/129,079

(22) Filed: May 29, 2008

(65) Prior Publication Data

US 2009/0293365 A1 Dec. 3, 2009

(51) Int. Cl.
*E05F 3/02* (2006.01)
*E05B 65/04* (2006.01)

(52) U.S. Cl. ..... 16/66; 16/49; 49/61; 49/62; 49/63; 49/67

(58) Field of Classification Search ..... 16/66, 67, 16/69, 70, 71, 80, 49; 292/194, 195, 216, 292/219, 225, 227, 228; 49/61, 62, 63, 67
See application file for complete search history.

(56) References Cited

U.S. PATENT DOCUMENTS 2,000,366 A * 5/1935 Victor ..... 160/92
3,162,889 A * 12/1964 Runnels ..... 16/66
3,289,242 A * 12/1966 Mallory ..... 16/66
4,022,263 A * 5/1977 Beckett et al. ..... 160/92
4,078,779 A * 3/1978 Molders ..... 267/120
4,596,383 A * 6/1986 Howard ..... 267/64.12
4,813,100 A * 3/1989 King ..... 16/49
5,358,225 A * 10/1994 Volpel et al. ..... 267/64.12
5,592,780 A * 1/1997 Checkovich ..... 49/386
5,855,039 A * 1/1999 Crawford ..... 16/49
6,273,405 B2 * 8/2001 Okamoto ..... 267/64.12
6,601,834 B2 * 8/2003 Perry ..... 267/64.12
6,910,302 B2 * 6/2005 Crawford ..... 49/379
6,938,302 B2 * 9/2005 Lin ..... 16/72
7,731,165 B2 * 6/2010 Schmidt ..... 267/195

* cited by examiner

*Primary Examiner* — Victor Batson
*Assistant Examiner* — Emily Morgan
(74) *Attorney, Agent, or Firm* — K&L Gates LLP

(57) ABSTRACT

A door positioning system is provided. The system includes a first member and a second member. The first member is attached to an exterior door at a first end of the first member and to an anchor location at a second end of the first member opposite the first end. The first member includes a locking region. The second member is configured to engage the locking region of the first member if the exterior door is opened a first threshold amount. The second member and locking region are configured to hold the exterior door in an open position if the second member is engaged with the locking region. The second member and locking region are configured to disengage if the exterior door is opened a second threshold amount beyond the first threshold amount. The exterior door is able to close with the force of the door closer if the second member is disengaged from the locking region.

6 Claims, 9 Drawing Sheets

DELAYED ACTION DOOR CONSTRAINT WITH REMOTE CLOSING BY AND OF A SECOND DOOR

BACKGROUND

Frequently, a house entry has both a storm door (e.g., an exterior door) and a regular entry door. A storm door can be any suitable type of exterior door in a double-door system and can include glass, screen, metal, plastic, wooden or any other suitable portions. The storm door, when opened, is generally constrained and held under tension by a storm door closer, a device which biases the storm door to a closed position. As a result, the storm door must be physically held open by the person entering until the inner door is opened. The person entering the house releases the storm door as he passes through the inner door. Such an entry system can be particularly troublesome when packages or other objects are being carried or the person entering the house is in a wheelchair or on crutches.

SUMMARY

In one embodiment, a door positioning system is provided. The system includes a first member and a second member. The first member is attached to an exterior door at a first end of the first member. The first member is removably attached to an anchor location (e.g., in one embodiment, the first member is removably attached indirectly to a door jam) at a second end of the first member opposite the first end. The first member includes a locking region. The second member is configured to engage the locking region of the first member if the exterior door is opened a first threshold amount. In one embodiment, one end of the first member is an end of a piston rod, wherein the piston rod is opposed by a spring. In one embodiment, the second member is attached to the anchorage. The second member and locking region are configured to hold the exterior door in an open position if the second member is engaged with the locking region. The second member and locking region are further configured to disengage if the exterior door is opened a second threshold amount beyond the first threshold amount. The exterior door is able to close if the second member is disengaged from the locking region.

In one embodiment, the first threshold amount is within the range of eighty degrees to one hundred degrees. In another embodiment, the first threshold amount is within the range of eighty-five degrees to ninety-five degrees. In still another embodiment, the second threshold amount is within the range of two to thirty degrees beyond the first threshold amount. In another embodiment, the second threshold amount is within the range of three to five degrees beyond the first threshold amount. In yet another embodiment, the first threshold amount and the second threshold amount are adjustable. In one embodiment, the locking region includes a depression in the first member. In another embodiment, the locking region includes a protrusion from the first member. In yet another embodiment, the locking region includes the end of the first member.

In still another embodiment, the system includes a third member. The third member is coupled to the second member at a first end of the third member. The third member is also coupled to an inner door at a second end of the third member. The third member is configured to disengage the second member from the locking region if the inner door is opened a third threshold amount.

In one embodiment, the system includes an indicator configured to indicate whether the second member and the locking region are engaged. In another embodiment, the indicator is selected from the group consisting of: a visual indicator, a tactile indicator, an audible indicator, an olfactory indicator, one or more markings on a floor or ground, a buzzer, a vibrator, a scent sprayer, a light, a bell, a whistle, an electromagnetic field generator, a transmitter, and an indicator detectable by a human being or guide animal.

In one embodiment, a method for positioning an exterior door is provided. The method includes providing a first member and providing a second member. The first member is attached to the exterior door at a first end of the first member and the first member is attached to an anchor location at a second end of the first member opposite the first end. The first member includes a locking region. The second member is configured to engage the locking region of the first member if the exterior door is opened a first threshold amount. The second member and locking region are configured to hold the exterior door in an open position if the second member is engaged with the locking region. The second member and locking region are further configured to disengage if the exterior door is opened a second threshold amount beyond the first threshold amount. The exterior door is able to close if the second member is disengaged from the locking region or if a substantial closing force is applied to the exterior door.

In one embodiment, the first threshold amount is within the range of eighty degrees to one hundred degrees. In another embodiment, the first threshold amount is within the range of eighty-five degrees to ninety-five degrees. In still another embodiment, the second threshold amount is within the range of two to thirty degrees beyond the first threshold amount. In yet another embodiment, the second threshold amount is within the range of three to five degrees beyond the first threshold amount.

In one embodiment, the locking region includes a depression in the first member. In another embodiment, the method includes providing a third member. The third member is coupled to the second member at a first end of the third member. The third member is also coupled to an inner door at a second end of the third member. The third member is configured to disengage the second member from the locking region if the inner door is opened a third threshold amount.

In one embodiment, the method includes providing an indicator configured to indicate whether the second member and the locking region are engaged.

Additional features and advantages are described herein, and will be apparent from, the following Detailed Description and the figures.

DETAILED DESCRIPTION

Figure 1:
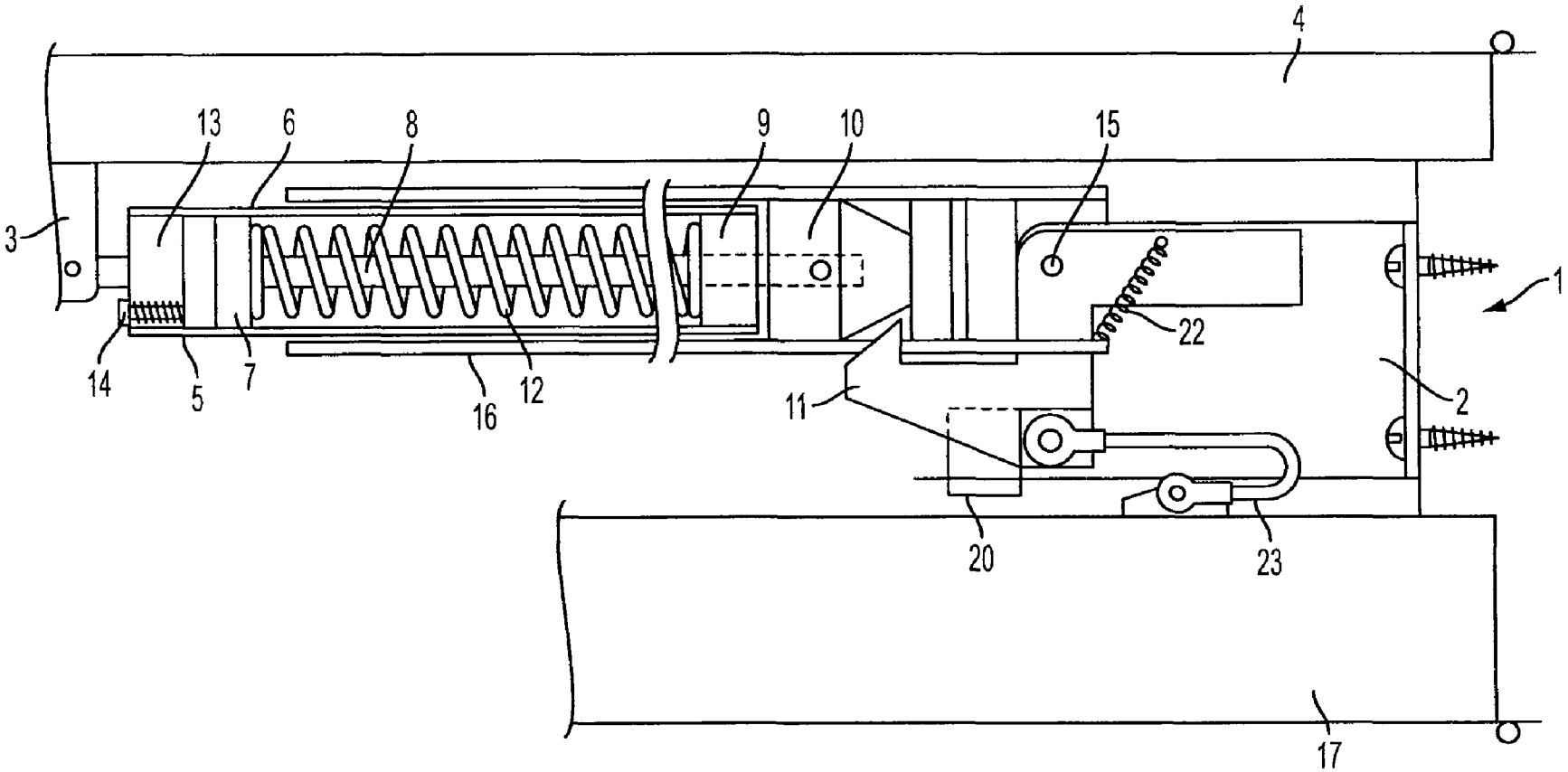
FIG. 1 is a diagram of a door constraint device, viewed parallel to the closed door in accordance with one embodiment.

In one embodiment, a device is provided with an exterior door closer (e.g., a storm door closer). The device holds the exterior door open indefinitely when placed (e.g., by sufficiently opening the door) in a first locking or holding position. Preferably, the first locking position is approximately 90 degrees open, but the first locking position can be any suitable amount of degrees open, such as the range from about 0 to about 180 degrees and all ranges therein by thousandths of a degree increments.

In one preferred embodiment, the device controls the closing action of an installed door closer on an exterior door. The device does not interfere with the normal operation of the installed door closer unless a user wishes to hold the exterior door open for some predetermined period of time. In one embodiment, if an exterior door having the device is opened approximately 90 degrees, the device locks and holds the exterior door in an opened position. In one embodiment, if the door is pushed open an additional few degrees (e.g., or any suitable number of degrees), the device unlocks after a delay period of 5 to 10 seconds giving a user time to clear the door's closed position. It should be appreciated that the delay period can be any suitable delay period.

In one alternative embodiment, the device can also be configured to removably connect to a second door, such as an inner door, as an additional way to release the device from the locked position. In this embodiment, the device can be configured to connect to the second door such that when the second door is opened approximately 90 degrees or more, the device unlocks. It should be appreciated that the opening position of the second door that causes the device to unlock can be any suitable amount of degrees open, including any in the range from about 0 to about 180 degrees and all ranges therein by thousandths of a degree increments. In this manner, the device enables a user, such as a person in a wheelchair to unlock the device without requiring further access to the exterior door. In one embodiment, if the connection to the second door is not required, the connection to the second door can be disconnected, thus freeing any link between the device and the second door.

In one embodiment, if the door is further opened, the exterior door will close after a time delay that is adjustable by the user. In one embodiment, opening the exterior door a specific amount of degrees further causes the exterior door to close after a delay. The specific amount of degrees can be any suitable amount or range of amounts, such as an amount between about 0 and about 180 degrees in thousandths of a degree increments. In various other embodiments, opening the exterior door to or past a second position causes the exterior door to close after a delay.

In one embodiment, a connection is made to the inner door so that the inner door unlatches the exterior door upon opening any suitable amount. In another embodiment, an additional device enables the user leaving the residence to close the inner door while outside the house next to the exterior door when the exterior door is in the locked open position.

In various embodiments, the system is completely or primarily mechanical; however, the system can include electronic components in various embodiments if desired. Further, in various embodiments, when the exterior door is not in a locked open position, it does not interfere with the normal exterior door use or the normal inner door use. In one embodiment, the device is connected to the inner door so that its full opening of the inner door releases the holding mechanism of the exterior door. In various other embodiments, less than full opening of the inner door can release the holding mechanism.

In one embodiment, an inner door closing device is added to the doors, enabling the closing of the inner door from outside. The inner door closing device does not interfere with the normal operation of the inner door other than closing the door in certain desired conditions. In one embodiment, all elements of the system are installed without modification of the doors or door frame; however, in various embodiments, the doors and/or door frames can be modified, if desired.

Figure 2:
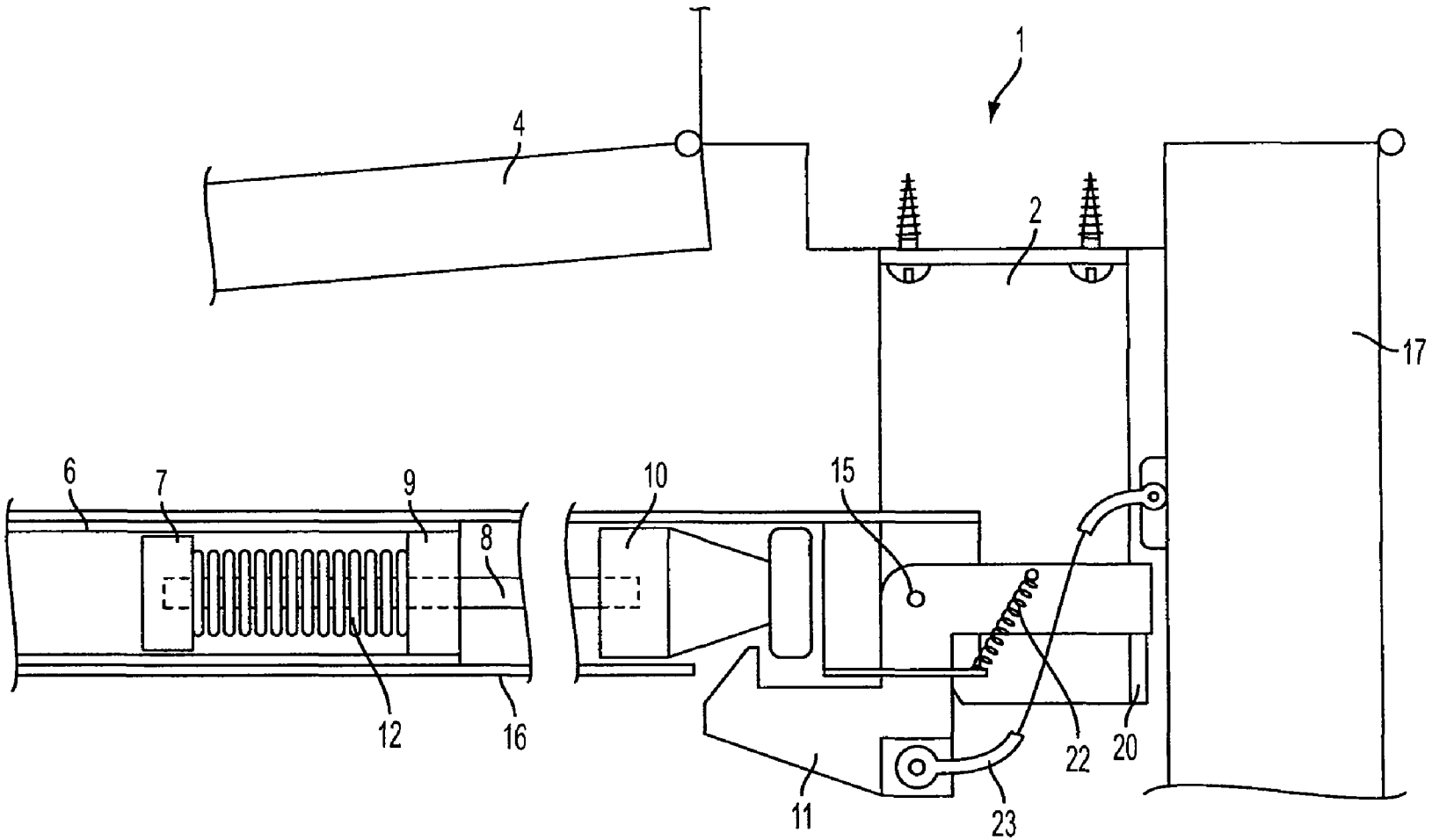
FIG. 2 is a diagram of a door constraint device viewed parallel to the opened exterior door in accordance with one embodiment.

As illustrated in FIG. 1 with the door closed and FIG. 2 with the door open, a mechanism of one embodiment is securely mounted to vertical door jamb 1 by bracket 2 in such a location that it does not interfere with a normal door closer. In this embodiment, the mechanism mounts and operates in some ways in a manner similar to that of a traditional exterior door closer. The body of the mechanism is attached by pivotal mount 3 to exterior door 4. The body of the mechanism includes an air compression device 5 with a cylinder 6 enclosing piston 7 with piston rod 8 moveably extending through guide 9 secured in cylinder 6 and affixed to rod detent 10 restrained by latch 11. The entire cylinder slides inside guide tube 16, held and pivoted on pin 15. It should be noted in other embodiments, less than the entire cylinder slides inside guide tube 16. Latch 11 also pivots on pin 15. When the exterior door 4 is opened, increasing the distance between mount 3 and pivot 15, spring 12 is compressed and air is drawn into the cylinder 6 through piston 7. The air is contained by cylinder head 13. If latch 11 is released the air is compressed by spring 12 and the rate of travel of rod detent 10 is controlled by adjustable air relief screw 14. Latch 11 rotates on pivot 15 with respect to mount 3.

Figure 3A:
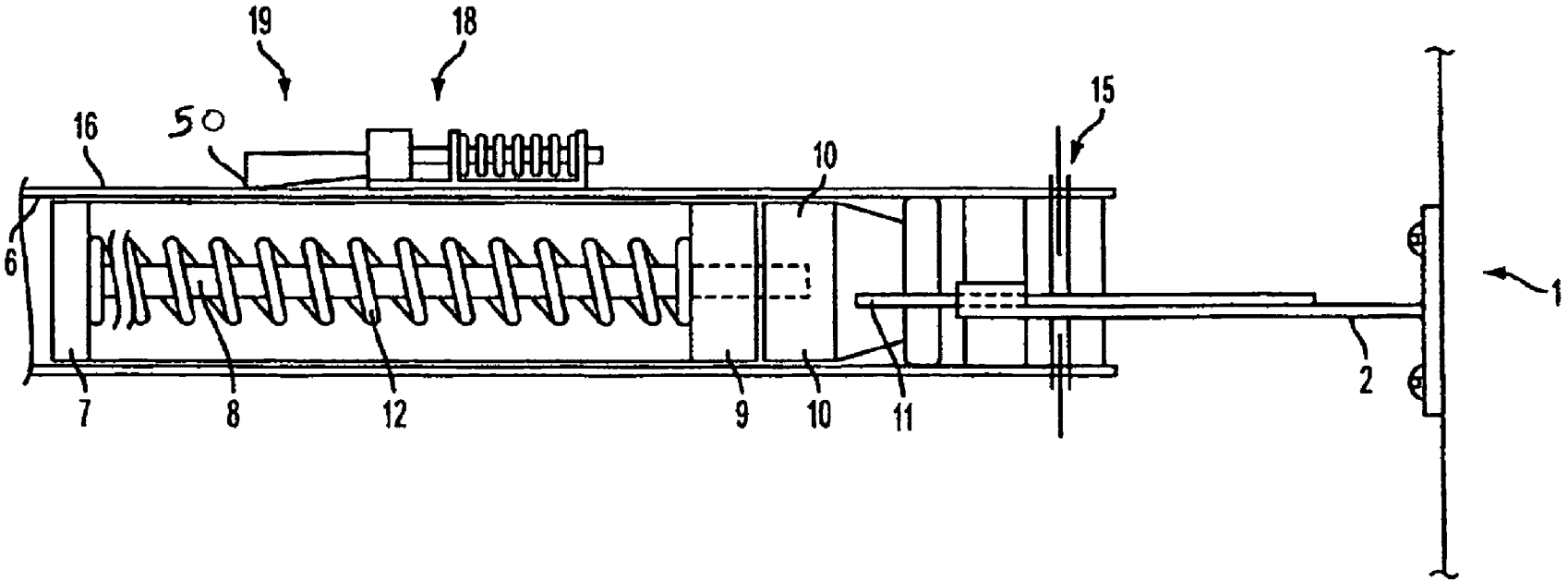
FIGS. 3A, 3B, 3C, and 3D are diagrams of a door constraint device viewed perpendicular and parallel to a closed and opened exterior door in accordance with different embodiments.
Figure 3B:
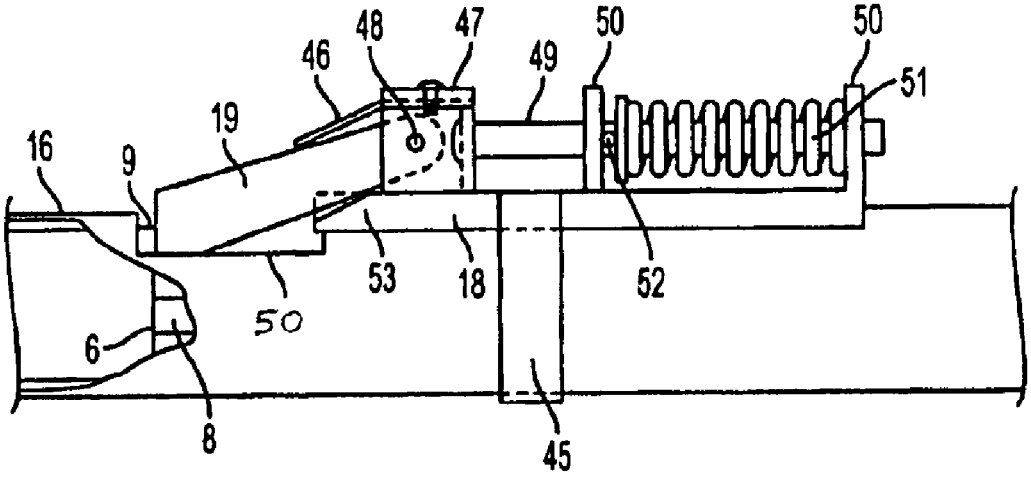

As shown in FIGS. 3A and 3B, in one embodiment, when exterior door 4 reaches 90 degrees open (or any other suitable position, such as being open between about 0 and about 180 degrees in thousandths of a degree increments), cylinder 6 slides in tube 16, the holding device 18, which by spring force, lowers catch 19 through a recess 50 in tube 16, engaging guide 9 of the cylinder from retracting to its closed position by the force of the door closer. In one embodiment, the position of catch 19 is adjustable, such that the position at which the door is locked open can be adjusted from 85 degrees to 95 degrees open or any other suitable values inside or outside of that range. In one embodiment, the locked open position can be between about 0 and about 180 degrees in thousandths of a degree increments. In various embodiments, visual, audible, olfactory and/or tactile indicators are present to make a user aware of when the door is positioned to lock the door open and/or release the lock. Such indicators include markings (e.g., spots) on a floor, a buzzer, a vibrator, a scent sprayer, a light or any other indicator detectable by a human being or guide animal. In this embodiment, recess 50 is of sufficient length that the door may be opened a few more degrees (or any other suitable amount, such as an amount between about 0 and about 180 degrees in thousandths of a degree increments) to maintain catch 19 in the engaged position.

FIG. 3B is an illustration of one embodiment of holding device 18 which is rigidly, but removably held in place on tube 16 by band 45, wherein holding device 18 includes a force release mechanism. It should be appreciated that holding device 18 can be held in place in any suitable manner.

Holding device 18 can also be positioned on tube 16 in any suitable position. In one embodiment, similar devices can be incorporated to enable holding device 18 to be repositioned to adjust the position of engagement of catch 19 with guide 9. In one embodiment, adjusting holding device 18 effects the position at which door 4 is held open. In FIG. 3B, exterior door 4 is in the held open position with catch 19 engaging guide 9 through recess 50 in tube 16 by the force of spring 46. If an outside force (e.g., the wind, human or animal intervention, or any suitable force) is applied to exterior door 4 to close exterior door 4, a slide 47, to which catch 19 is pinned at point 48, will move rod 49 fixed to slide 47. The rod slides through guides 50 compressing spring 51 by pin 52. In one embodiment, pin 52 is removably or fixedly attached to rod 49 in any suitable manner. Catch 19 is drawn across the base of holding device 18 at a position 53 moving catch 19 out of engagement with guide 9, releasing exterior door 4 and allowing exterior door 4 to close.

Figure 3C:
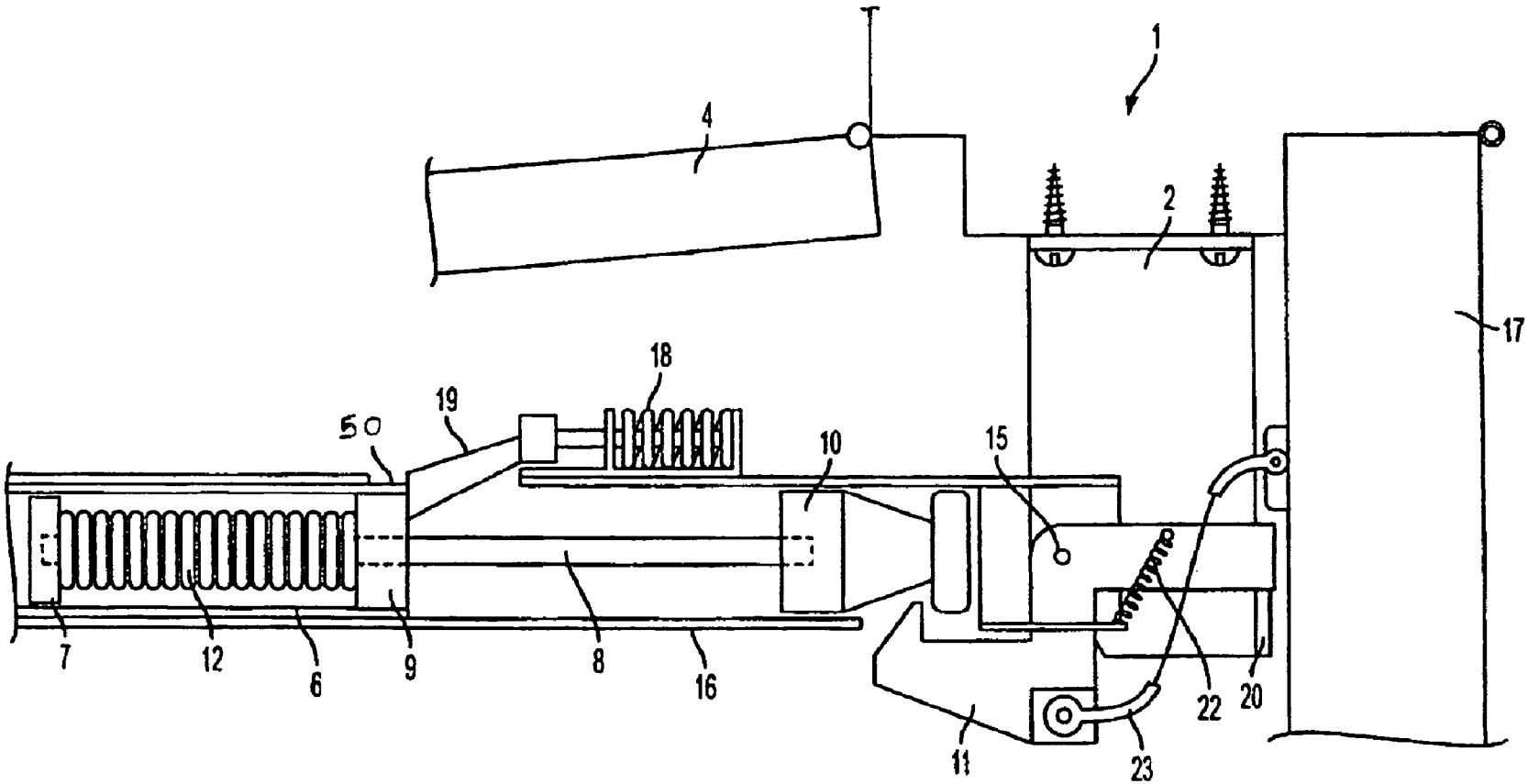

FIG. 3C is an illustration of one embodiment of holding device 18 that is removably held in place in a position on tube 16 that is different than illustrated in FIG. 3B. Recess 50 is accordingly adjusted to accommodate the different position of holding device 18. In this embodiment, exterior door 4 is in the held open position with catch 19 engaging guide 9 through recess 50 in tube 16. The distance between mount 3 and pivot 15 is increased and spring 12 is compressed. FIG. 3C also illustrates that spring 12 remains compressed when catch 19 engages guide 9 through recess 50 in tube 16.

Figure 3D:
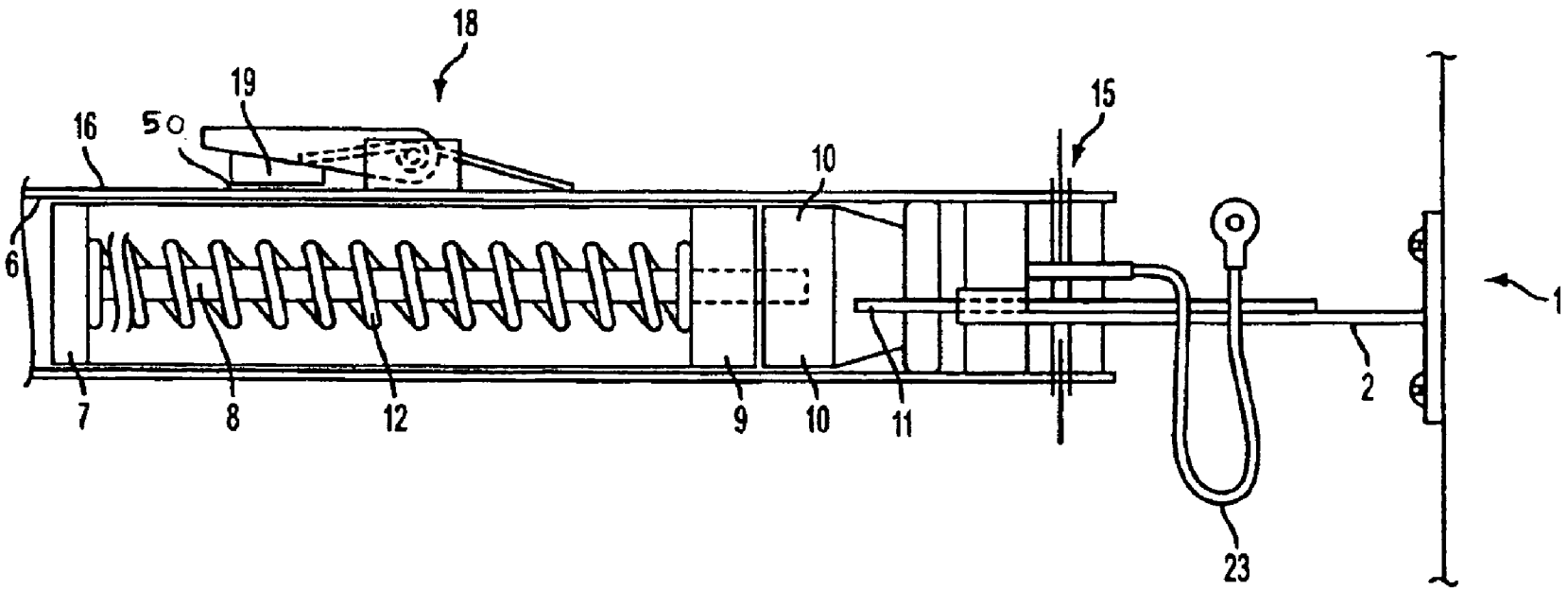

As shown in FIG. 3D, in one alternative embodiment, when exterior door 4 reaches 90 degrees open (or any other suitable position, such as being open between about 0 and about 180 degrees in thousandths of a degree increments), cylinder 6 slides in tube 16, an alternative holding device 18, which by spring force, lowers catch 19 through a recess 50 in tube 16, engaging guide 9 of the cylinder from retracting to its closed position by the force of the door closer. In this embodiment, holding device 18 does not include a force release mechanism as described in FIG. 3B. However, it should be appreciated that this holding device 18 may include a force release mechanism as described in FIG. 3B or any other suitable force release mechanism.

Projection 20 is a stop affixed to mount 2. In this embodiment, if exterior door 4 is rotated open several more degrees (e.g., three, five, ten or any other suitable amount of degrees, such as an amount between about 0 and about 180 degrees in thousandths of a degree increments), latch 11 restrained by projection 20 releases rod detent 10. The compressed spring 12 then drives piston 6, compressing the air in cylinder 6. The air's release time is controlled by relief screw 14 as illustrated in FIG. 1. When the leading edge of rod detent 10 reaches the tapered blocking wedge 19 of latch device 18, wedge 19 is forced out of engagement with guide 9 allowing exterior door 4 to close in a controlled mode by the exterior door closer. Spring 22 attached to tube 16 returns lever 11 to its locking position when the door is closed.

In one embodiment, a release feature present in various embodiments is illustrated in FIGS. 1 and 2. The release feature enables the inner door 17 to close exterior door 4 by attaching a short cable 23 (it should be appreciated that the cable can be any suitable length) to latch 11 and inner door 17. When exterior door 4 is in a held open position, cable 23 of the proper length will release latch 11 if door 17 is opened.

The cable 23 length in this embodiment is such that when inner door 17 is opened approximately 90 degrees, cable 23 is placed under tension causing latch 11 to rotate and release rod detent 10, causing exterior door 4 to close. However, the inner door 17 can be opened to any suitable position to cause exterior door 4 to close, wherein the suitable position can range between about 0 and about 180 degrees in thousandths of a degree increments. A door stop or chain is preferably provided to prevent inner door 17 from opening so far it damages the constraining device. However, such a door stop or chain is not required.

Figure 4:
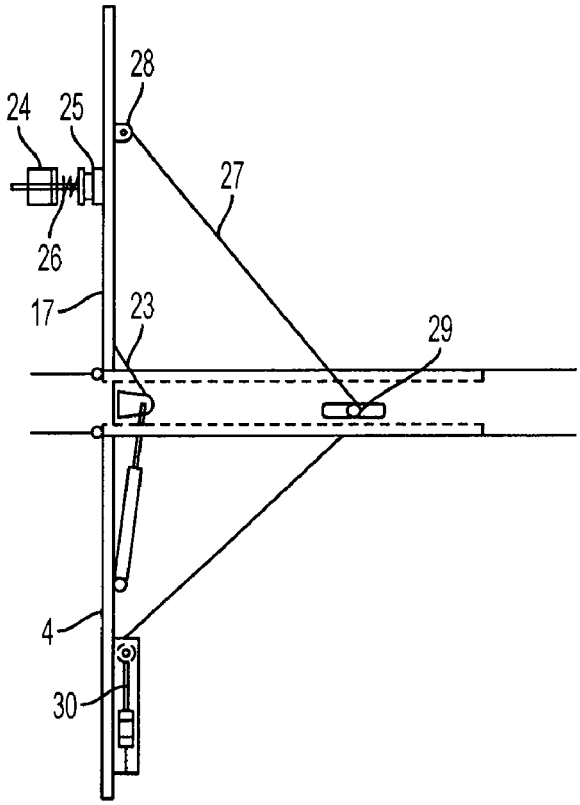
FIG. 4 is a diagram of an inner door closing system viewed parallel to the opened door in accordance with one embodiment.

A preferred stop in accordance with one embodiment is shown in FIG. 4. A spring compression stop 24 with a magnet 25 holding the inner door 17 at approximately 90 degrees (or any amount between about 0 and about 180 degrees in thousandths of a degree increments) open and with all slack out of cable 23 accommodates easier egress past inner door 17. The exterior door release occurs if inner door 17 is pushed open further against spring 26 causing cable 23 to release latch 11.

Figure 5:
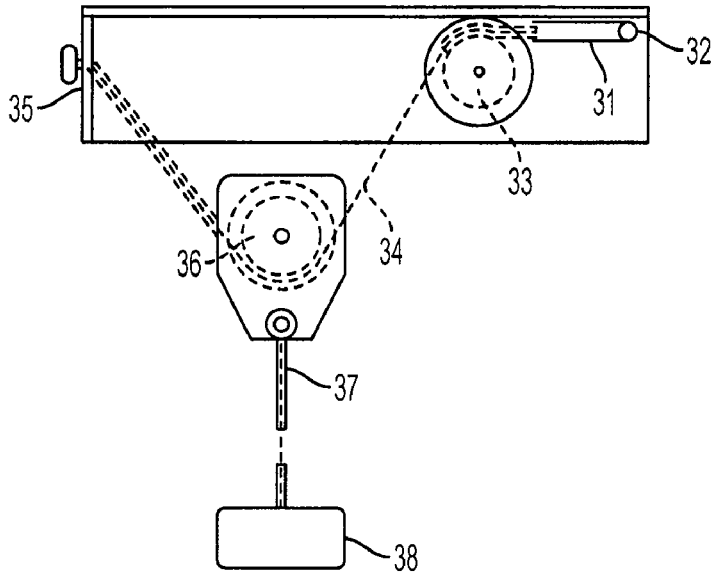
FIG. 5 is a diagram of a fixture mounted on an exterior door which is used in closing an inner door in accordance with one embodiment.

Another embodiment having a locked open exterior door 4 is illustrated in FIGS. 4 and 5, wherein a connection to the inner door enables the inner door to be closed without requiring a user to physically touch the inner door. When a user is exiting, inner door 17 is held by door stop 24. The exterior door 4 is pushed open to the locked position. A cord 27, which is attached to inner door 17 at a point 28 near the top of the door, runs through an over head door frame pulley 29 and on to lanyard bracket 30 securely attached near the top of exterior door 4. As shown in FIG. 5, the cord 27 entering pulley 31 at point 32. The cord 27 engages pulley 33 putting the cord 27 in the vertical plane. A catenary 34 is formed in the cord 27 with the end of the cord 27 secured at 35 in the lanyard bracket 29. Pulley 36 is cradled in the catenary 34. When the pull cord knob 37 is pulled down, pulley 36 extends the catenary 34, causing inner door 17 to close. The catenary arrangement reduces the distance pull cord knob 38 must travel to pull the door closed. In one embodiment, the exterior door 4 may be opened a predetermined number of degrees to release it from the locked open position.

Figure 6:
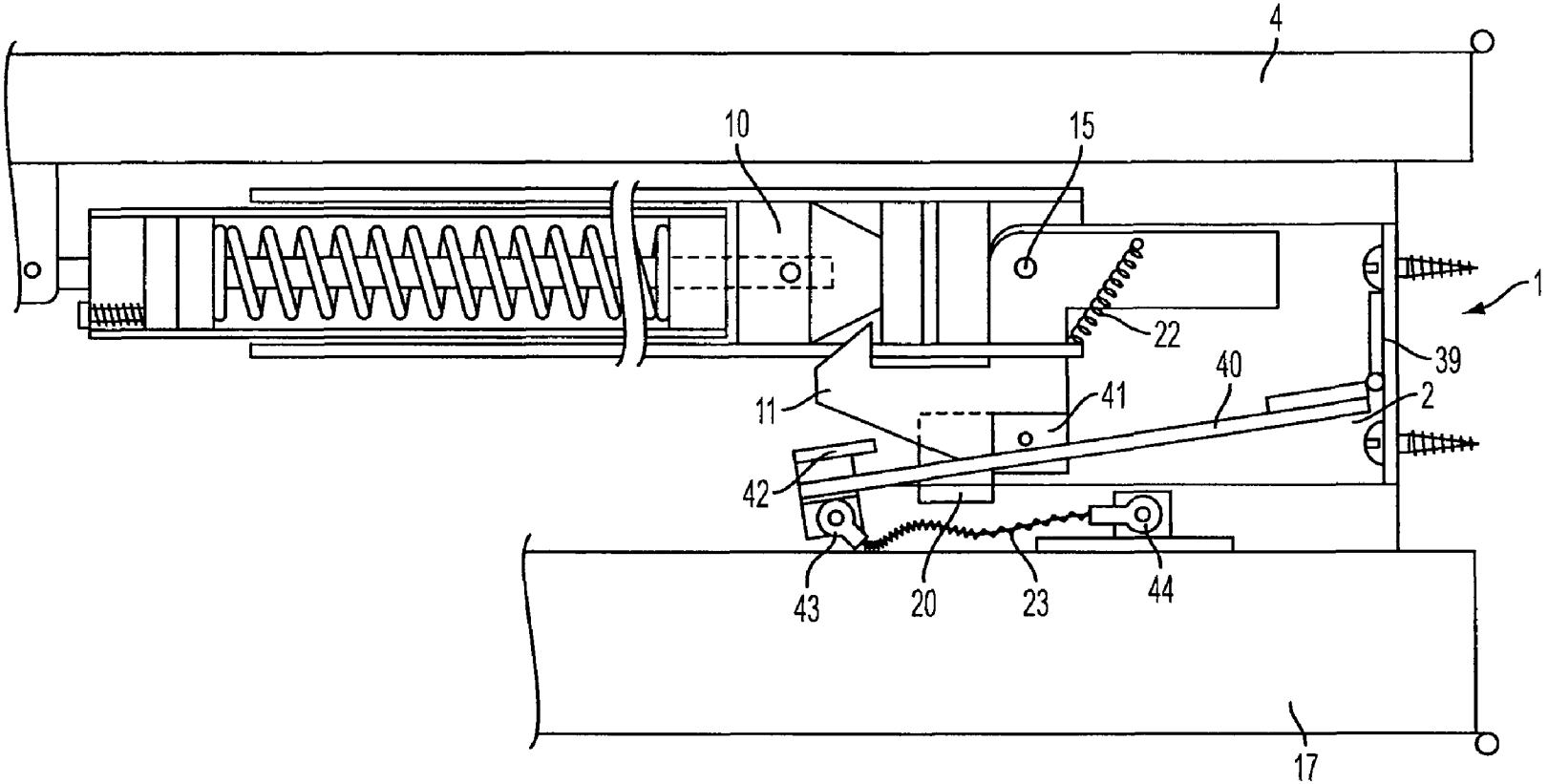
FIG. 6 is a diagram of the door constraint device, viewed parallel to the closed door in accordance with one embodiment.
Figure 7:
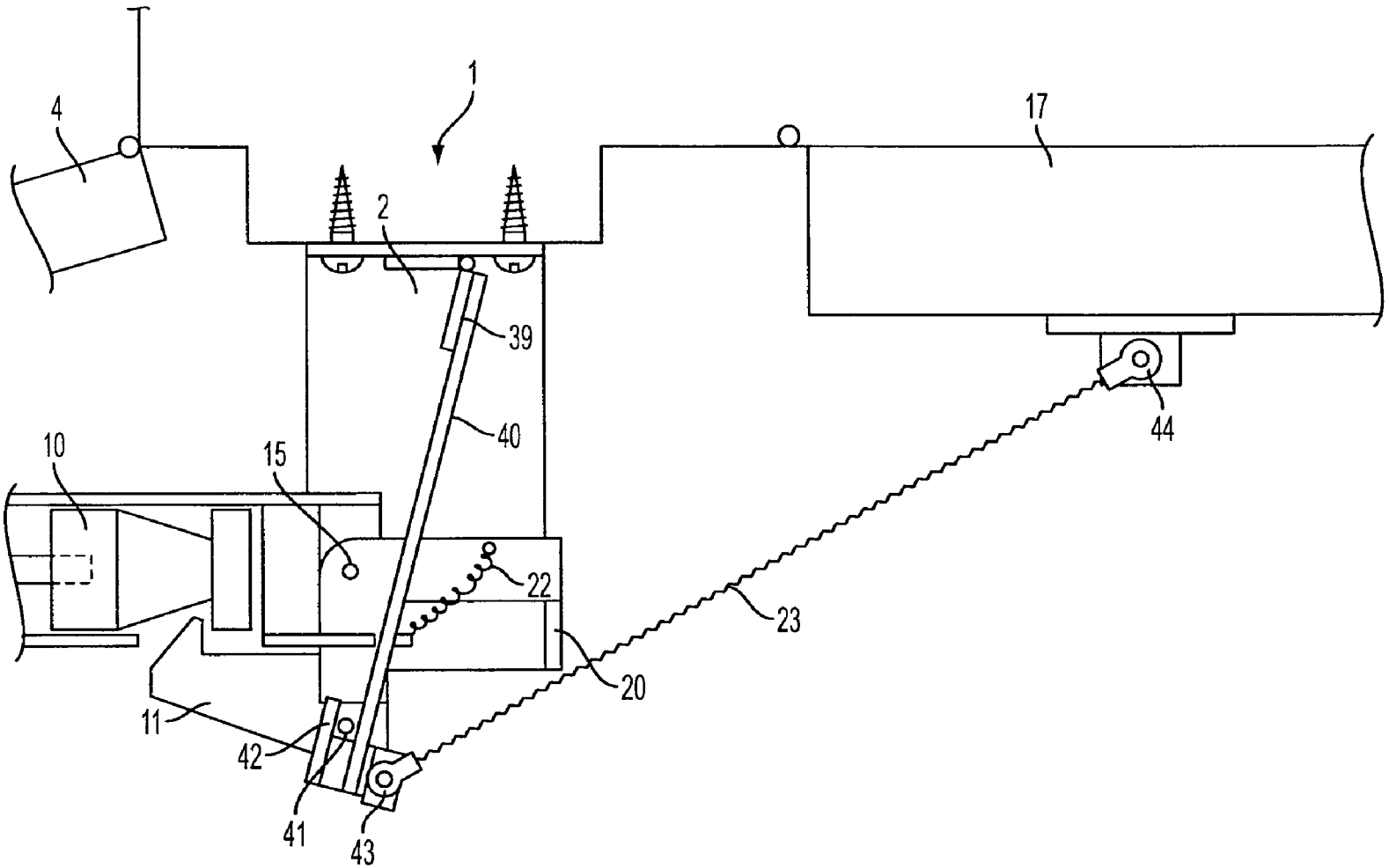
FIG. 7 is a diagram of a door constraint device viewed parallel to the opened exterior door in accordance with one embodiment.

In one alternative embodiment, as illustrated in FIGS. 6 and 7, a release mechanism enables inner door 17 to fully open while minimizing potential damage to the mechanism that holds open exterior door 4, while still enabling inner door 17 to release exterior door 4 from a locked open position through attached cable 23. In one embodiment, the configuration enables inner door 17 to be fully opened approximately 180 degrees and still retain the ability to release the locked open position of exterior door 4; however it should be appreciated that inner door 17 may be opened any suitable amount between about 0 and about 180 degrees in thousandths of a degree increments. In FIG. 6, spring closing hinge 39 is affixed to bracket 2 with shaft 40 fixed to the movable half of spring closing hinge 39. Shaft 40 rests against pin 41 with the closing force of hinge 39. Latch 42 is affixed to shaft 40 so that it can engage pin 41. It should be appreciated that latch 42 can be permanently or removably fixed to shaft 40.

As illustrated in FIG. 7, exterior door 4 is opened, pivoting the entire door release mechanism to approximately 90 degrees. Shaft 40 slides substantially against pin 41 until movement is arrested when pin 41 is captured under a lip of latch 42; however it should be appreciated that shaft 40 may be in intermittent communication with pin 41 until pin 41 is captured under the lip of latch 42. It should also be appreciated that shaft 40 is not required to be in communication with pin 41. In one embodiment, when pin 41 is captured under the lip of latch 42, the locked open position of door 4 can still be released, as previously described, by opening door 4 a predetermined amount (e.g., removing latch 11 from engagement with the timing mechanism). In one embodiment, latch 11 is also released by further opening door 17. When door 17 is opened a predetermined number of degrees (e.g., 45 degrees or any suitable number of degrees), tensioned cable 23 pulls arm assembly 40 and 42 causing latch 11 pivoting on pin 15 to release rod detent 10. Latch 11 also pivots on pin 15 with a much shorter radius than shaft 40 on hinge 39, thus pin 41 will exit from under the lip of latch 42 when rotated a predetermined number of degrees. It should be appreciated that when cable 23 pulls arm assembly 40 and 42 to cause latch 11 to release rod detent 10, pin 41 may also simultaneously exit from under the lip of latch 42. In one embodiment, as inner door 17 is opened, shaft 40 is rotated about 90 degrees (e.g., or any suitable number of degrees) to provide an adequate length of cable 23 to enable door 17 to fully open.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A door positioning system comprising:

a guide tube pivotally attached to a door jamb, the guide tube including a recess formed by an opening located in a wall of the guide tube;

a holding device mounted adjacent to the recess on an exterior surface of the wall of the guide tube;

an air compression device slidably positioned within the guide tube and pivotally attached to an exterior door;

the holding device engaging a cylinder of the air compression device through the recess of the guide tube if the exterior door is opened a first threshold amount, holding the exterior door in an open position, wherein the holding device moves to engage the cylinder independently of any movement of the guide tube;

a latch engaging a rod detent of the air compression device;

the latch disengaging the rod detent of the air compression device when an interior door is opened; and the rod detent causing the holding device to disengage the cylinder of the air compression device when the interior door is opened, allowing the exterior door to close.

2. The door positioning system of claim 1, wherein the first threshold amount is within the range of eighty degrees to one hundred degrees.

3. The door positioning system of claim 1, wherein the first threshold amount is within the range of eighty-five degrees to ninety-five degrees.

4. The door positioning system of claim 1, wherein the first threshold amount is adjustable.

5. The door positioning system of claim 1, wherein the holding device includes a catch for engaging the cylinder of the air compression device.

6. A door positioning system comprising:

a guide tube including an aperture, one end of the guide tube being rotatably coupled to a door jamb bracket;

an interior cylinder including a guide and a rod detent, the interior cylinder slideably engaged at least partially within the guide tube, and one end of the interior cylinder being rotatably coupled to an exterior door;

a holding device including a catch, the holding device coupled to the guide tube such that the catch is positioned above the aperture of the guide tube and is movable, independently of any movement of the guide tube, to engage the interior cylinder through the aperture and to disengage the interior cylinder by the movement of the rod detent when an interior door is opened;

a latch rotatably coupled to the door jamb bracket and removably coupled to the rod detent;

a latch rotatably coupled to the door jamb bracket and removably coupled to the rod detent.

* * * * *